US010388472B2

(12) United States Patent
Zhang

(10) Patent No.: US 10,388,472 B2
(45) Date of Patent: Aug. 20, 2019

(54) KEYBOARD STRUCTURE

(71) Applicant: JIANGSU TRANSIMAGE TECHNOLOGY CO., LTD., Gaoyou, Jiangsu Province (CN)

(72) Inventor: Qing Zhang, Gaoyou (CN)

(73) Assignee: Jiangsu Transimage Technology Co., Ltd., Gaoyou, Jiangsu Province (CN)

( * ) Notice: Subject to any disclaimer, the term of this patent is extended or adjusted under 35 U.S.C. 154(b) by 0 days.

(21) Appl. No.: 15/804,420

(22) Filed: Nov. 6, 2017

(65) Prior Publication Data

US 2018/0366283 A1 Dec. 20, 2018

(30) Foreign Application Priority Data

Jun. 16, 2017 (CN) ..... 2017 1 0457969

(51) Int. Cl.

*H01H 13/70* (2006.01)
*H01H 13/7057* (2006.01)
*H01H 13/704* (2006.01)
*H01H 13/82* (2006.01)

(52) U.S. Cl.

CPC ..... *H01H 13/7057* (2013.01); *H01H 13/704* (2013.01); *H01H 13/82* (2013.01); *H01H 2213/002* (2013.01); *H01H 2223/002* (2013.01)

(58) Field of Classification Search

CPC ... H01H 13/82; H01H 13/7057; H01H 13/704
USPC ..... 200/5 A, 515
See application file for complete search history.

(56) References Cited

U.S. PATENT DOCUMENTS 4,349,712 A * 9/1982 Michalski ..... H01H 13/702 200/5 A
4,415,780 A * 11/1983 Daugherty ..... H01H 13/702 200/5 A
4,527,021 A * 7/1985 Morikawa ..... H01H 13/702 200/5 A
2014/0001021 A1* 1/2014 Zhang ..... H01H 3/125 200/5 C

* cited by examiner

*Primary Examiner* — Edwin A. Leon
*Assistant Examiner* — Iman Malakooti
(74) *Attorney, Agent, or Firm* — Rankin, Hill & Clark LLP

(57) ABSTRACT

A keyboard structure includes an elastomer, a flexible conductor and a conductive circuit board from top to bottom. The conductive circuit board is respectively provided with a circuit anode and a circuit cathode, the flexible conductor includes a flexible body and a conductive layer arranged on the flexible body. When pressing the elastomer, the circuit is switched on if the conductive layer on the flexible conductor is in contact with the circuit anode and the circuit cathode on the conductive circuit board. When loosening the elastomer, the circuit is switched off if the conductive layer on the flexible conductor is separated from the circuit anode and the circuit cathode on the conductive circuit board.

18 Claims, 4 Drawing Sheets

KEYBOARD STRUCTURE

TECHNICAL FIELD

The present invention relates to a keyboard structure, and more particularly, to a novel keyboard structure.

BACKGROUND

As a common input device, English letters, numbers and punctuation marks may be input into a computer through a keyboard, so as to give an order and input data to the computer. The current keyboard is relatively complicated in structure, and has higher manufacturing requirements. Meanwhile, the sensitivity of the keyboard, the control strength of the keys, the hand feeling effect, and the waterproof performance of the keyboard are expected to be optimized.

As illustrated in FIG. 1, the current keyboard structure comprises a conductive circuit board 1 and an elastomer 2 above the conductive circuit board, wherein the conductive circuit board 1 comprises an upper layer 103, a spacer layer 112 and a lower layer 105 from top to bottom, and the spacer layer is opened with a hole. At the moment, the lower surface of the upper layer is provided with an upper layer circuit 114, the upper surface of the lower layer is provided with a lower layer circuit 115. When pressing the elastomer 2, the upper layer circuit 114 is in contact with the lower layer circuit 115, and the circuit is switched on. However, because the upper layer 103 is made of PET, while PET is relatively hard, when pressing the elastomer 2, the bounciness is relatively large after the elastomer 2 is in contact with the upper layer 103. Therefore, a large force is needed to switch on the circuit which is uneasy to control, and causes poor operation performances. Meanwhile, a third ventilation path 113 is arranged between the upper layer 103 and the spacer layer 112 as well as between the lower layer 105 and the spacer layer 112. The periphery of the ventilation path 113 is provided with a circuit face, i.e., the ventilation path 113 exists in the circuit layer, which has the possibility of leakage and low waterproof performance.

The problems above are urgently to be solved.

SUMMARY

Object of the Invention

The present invention aims at providing a keyboard structure with good user experience and waterproofness.

Technical Solution

A keyboard structure according to the present invention comprises an elastomer, a flexible conductor and a conductive circuit board from top to bottom; wherein the conductive circuit board is respectively provided with a circuit anode and a circuit cathode, the flexible conductor comprises a flexible body and a conductive layer on the flexible body; when pressing the flexible body, the circuit is switched on if the conductive layer on the flexible conductor is in contact with the circuit anode and the circuit cathode on the conductive circuit board; when loosening the elastomer, the circuit is switched off if the conductive layer on the flexible conductor is separated from the circuit anode and the circuit cathode on the conductive circuit board.

A structure form of the conductive circuit board comprises an upper layer, a circuit layer and a lower layer from top to bottom, wherein the circuit anode and the circuit cathode are arranged on the circuit layer, the upper layer is provided with a first central hole used for providing a contact place for the conductive layer and the circuit anode and the circuit cathode, the upper surface of the circuit layer on two sides of the first central hole is a circuit face, a first air hole is arranged in the circuit layer under the first central hole, a first ventilation path is arranged between the circuit layer and the lower layer, and the air in the first central hole is communicated with the outside through the first air hole and the first ventilation path.

Another structure form of the conductive circuit board comprises an upper layer, a circuit protection layer and a circuit layer from top to bottom, wherein the circuit anode and the circuit cathode are arranged on the circuit layer, and the upper layer and the circuit protection layer are commonly provided with a second central hole used for providing a contact place for the conductive layer and the circuit anode and the circuit cathode, the upper surface of the circuit layer at two sides of the second central hole is the circuit layer, meanwhile, the second ventilation path is arranged between the upper layer and the circuit protection layer, and the air in the second central hole is communicated with the outside through the second ventilation path.

Wherein, the flexible body may be made of flexible rubber or flexible plastics, and preferably silica gel; moreover, the flexible body may also be made of TPU or TPE. The conductive layer is a printed conductive material or a conductive film.

The elastomer, the flexible conductor and the conductive circuit board are hermetically connected with each other. Meanwhile, the upper layer, the circuit layer and the lower layer on the first conductive circuit board are hermetically connected with each other. The upper layer, the circuit layer and the lower layer on the second conductive circuit board are hermetically connected with each other. Preferably, the hermetic connection is fitting by waterproof glue.

Beneficial effects: compared with the prior art, the present invention has the advantages that: the flexible conductor arranged between the elastomer and the circuit of the keyboard structure has very small bounciness, is easy to control, and is stable. A force needed for switching on the circuit is also relatively stable, the sensitivity is relatively good, and the operation performance is excellent; meanwhile, no ventilation path exists between circuit routing faces in the conductive circuit board, so that waterproof glue may be fully fit, and the waterproof effect is relatively good.

BRIEF DESCRIPTION OF THE DRAWINGS

FIG. 2(*b*) is a sectional view illustrating a pressing state of the keyboard of FIG. 2(*a*);

FIG. 2(*c*) is a sectional view of a second keyboard structure according to the present invention;

FIG. 3(*b*) is a schematic diagram of the elastomer in the keyboard structure according to the present invention;

FIG. 5(*b*) is an enlarged drawing of a point A in FIG. 5(*a*);

FIG. 5(*c*) is a schematic diagram illustrating routing of the second keyboard according to the present invention;

FIG. 5(*d*) is an enlarged drawing of a point A in FIG. 5(*c*); and

DETAILED DESCRIPTIONS

The technical solution of the present invention will be further described hereinafter with reference to the drawings.

Figure 1:
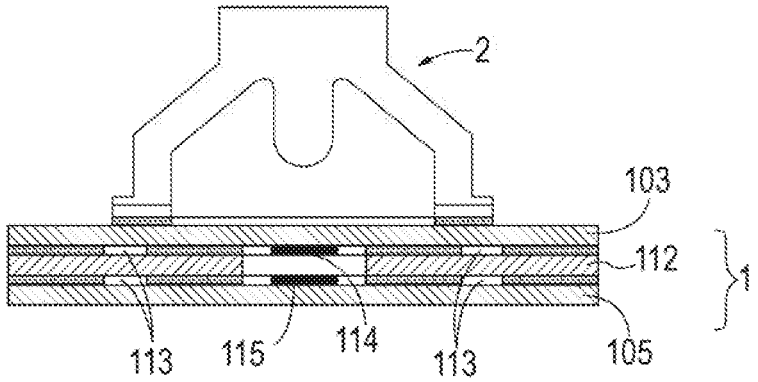
FIG. 1 is a sectional view of the current keyboard structure.
Figure 2A:
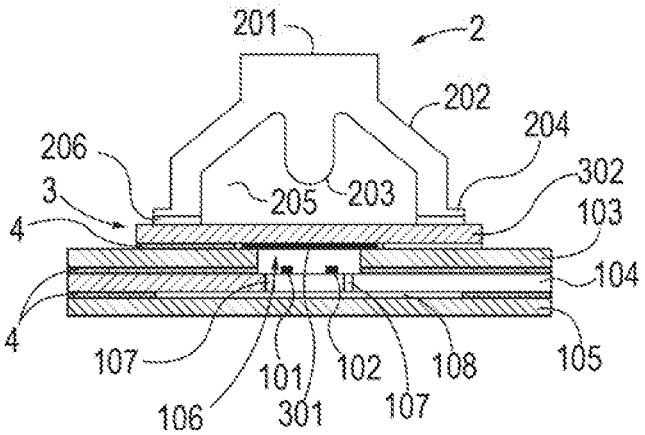
FIG. 2(*a*) is a sectional view of a first keyboard structure according to the present invention.
Figure 2B:
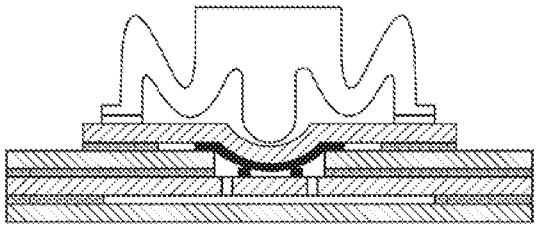
Figure 2C:
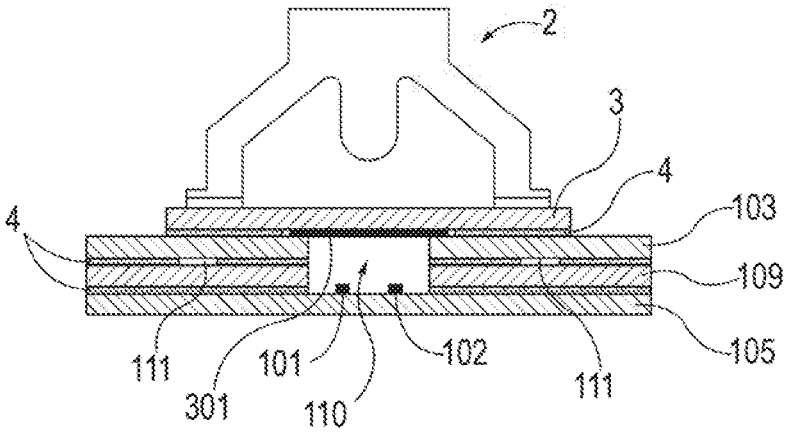

A keyboard structure according to the present invention comprises an elastomer 2, a flexible conductor 3 and a conductive circuit board 500 in FIGS. 2(*a*) and 600 in FIG. 2(*c*) from top to bottom, wherein the conductive circuit board is respectively provided with a circuit anode 101 and a circuit cathode 102, and the flexible conductor 3 is provided with a conductive layer 301.

The flexible conductor 3 comprises a flexible body 302 and a conductive layer 301 on the flexible body 302, wherein the flexible body 302 is made of a flexible insulating material, such as flexible rubber or flexible plastics, and is preferably silica gel; moreover, the flexible body 302 may be also made of TPU or TPE, and then the conductive material is printed on a flexible insulator, such as carbon or silver, or a conductive film is arranged.

Figure 5:
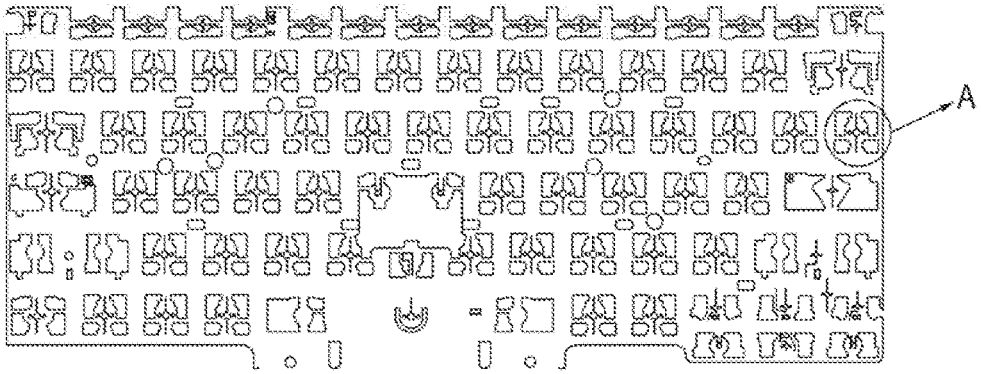
FIG. 5(*a*) is a schematic diagram illustrating routing of the first keyboard according to the present invention.
Figure 5B:
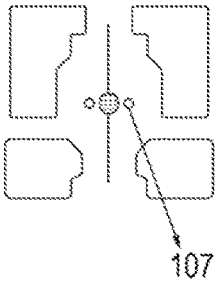
Figure 5C:
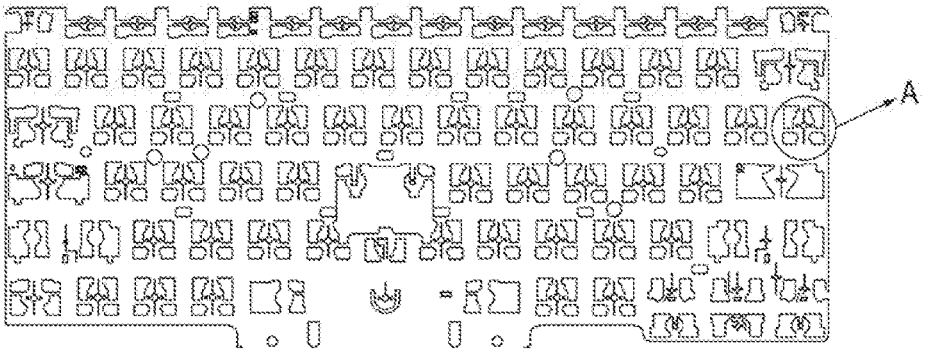
Figure 5D:
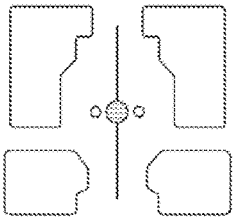

The conductive circuit board has two structures. As illustrated in FIG. 2(*a*), the first conductive circuit board 500 comprises three-layer structures from top to bottom: the upper layer 503, the circuit layer 504 and the lower layer 505, wherein the circuit anode 101 and the circuit cathode 102 are arranged above the circuit layer 504, the upper layer 503 is provided with a first central hole 106 used for providing a contact place for the conductive layer 301 and the circuit anode 101 and the circuit cathode 102, the upper surface of the circuit layer 504 on two sides of the first central hole 106 is a circuit face, and it is critical that this surface has no ventilation path, which increases the waterproofness; two first air holes 107 are arranged in the circuit layer 504 under the first central hole 106, a first ventilation path 108 is arranged between the circuit layer 504 and the lower layer 505, and the air in the first central hole 106 is communicated with the outside through the first air holes 107 and the first ventilation path 108 when the elastomer 2 is pressed or loosened, as illustrated in FIG. 2(*b*). The schematic diagrams illustrating the routing of the keyboard are as illustrated in FIGS. 5(*a*) and 5(*b*).

As illustrated in FIG. 2(*c*), the second conductive circuit board 600 comprises three-layer structures from top to bottom: an upper layer 603, a circuit protection layer 609 and a circuit layer 604, the circuit anode 101 and the circuit cathode 102 are arranged above the circuit layer 604, and the upper layer 603 and the circuit protection layer 609 are commonly provided with a second central hole 110 used for providing a contact place for the conductive layer 301 and the circuit anode 101 and the circuit cathode 102, the upper surface of the circuit layer at two sides of the second central hole 110 is a circuit layer, and it is critical that this surface has no ventilation path either, which increases the waterproofness; a jumper on the circuit layer is separated by the circuit protection layer 609, a second ventilation path 111 is arranged between the upper layer 603 and the circuit protection layer 609, and the air in the second central hole 110 is communicated with the outside through the second ventilation path 111, but the communicated part is not shown in the figure. In this way, a waterproof place is formed. The schematic diagrams illustrating the routing of the keyboard are as illustrated in FIGS. 5(*c*) and 5(*d*).

Figure 3A:
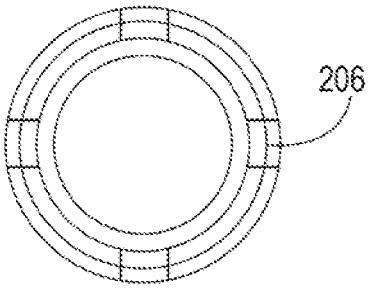
FIG. 3(*a*) is a top view of an elastomer in the keyboard structure according to the present invention.
Figure 3B:
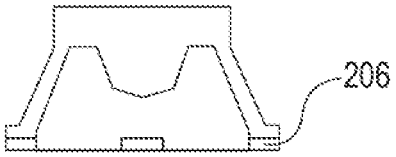
Figure 4:
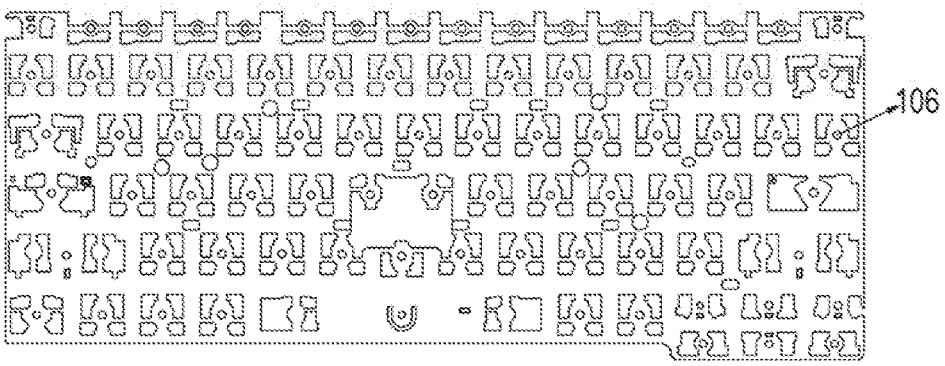
FIG. 4 is a schematic diagram of the keyboard according to the present invention.

As illustrated in FIG. 2(*a*) and FIG. 2(*b*), the elastomer 2 comprises a pressing portion 201, an elastic covering wall 202 formed by extending outwards from the pressing portion 201, and a connecting pin 203 extending downwards from a middle part of an internal wall of the pressing portion 201, wherein a bottom part 204 of the elastic covering wall is arranged on the conductive circuit board 500, 600, and a pressing place 205 is formed between the elastomer 2 and the conductive circuit board, 500, 600. Preferably, as illustrated in FIG. 3(*a*) and FIG. 3(*b*), a second air hole 206 is arranged around the bottom part 204 of the elastic covering wall, and the air in the elastomer 2 is communicated with the outside through the second air hole 206.

Figure 6:
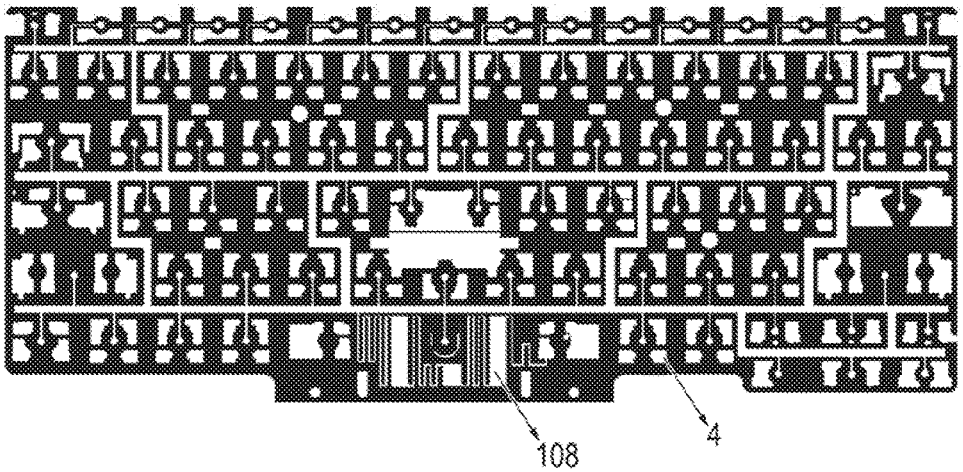
FIG. 6 is a schematic diagram illustrating fitting of waterproof glue in the keyboard according to the present invention.

As illustrated in FIG. 6, in order to increase the waterproofness of the keyboard, the elastomer 2, the flexible conductor 3 and the conductive circuit board 500, 600 are hermetically connected with each other. The upper layer 503, the circuit layer 504 and the lower layer 505 on the first conductive circuit board 500 are hermetically connected with each other, and the upper layer 603, the circuit protection layer 609 and the circuit layer 604 on the second conductive circuit board 600 are hermetically connected with each other. The hermetical connection here may be, but is not limited to fitting by the waterproof glue 4, i.e., the elastomer 2 is fitted on the flexible conductor 3 by the waterproof glue 4, and the flexible conductor 3 is fitted on the conductive circuit board by the waterproof glue 4, i.e., two sides of the conductive layer 301 are sealed by the waterproof glue 4 to prevent electric leakage, etc.

Working process: regarding the first conductive circuit board 500, when pressing the elastomer 2, the connecting pin 203 of the elastomer 2 presses the flexible conductor 3 to deform downwards to be in contact with the circuit anode 101 and the circuit cathode 102 on the circuit layer 504, and the circuit is switched on at the moment; in the process that the elastomer 2 is pressed and bounced, the air in the first central hole 106 comes in and goes out through the first air hole 107 on the circuit layer 504 and the first ventilation path 108 on the lower layer 505; and the air in the elastomer 2 comes in and goes out through the second air hole 206. Since the flexible conductor 3 has very small bounciness, is easy to control, and is stable, a force needed for switching on the circuit is also relatively stable, and the sensitivity is relatively good; moreover, no ventilation path exists between circuit faces of the structure, and glue fitting is adopted, so that the waterproof effect is relatively good.

Regarding the second conductive circuit board 600, when pressing the elastomer 2, the connecting pin 203 of the elastomer 2 presses the flexible conductor 3 to deform downwards to be in contact with the circuit anode 101 and the circuit cathode 102 on the circuit layer 604, and the circuit is switched on at the moment; in the process that the elastomer 2 is pressed and bounced, the air in the second central hole comes in and goes out through the second air hole on the circuit layer and the second ventilation path on the circuit layer; and the air in the elastomer 2 comes in and goes out through the second air hole.

The invention claimed is:

1. A keyboard structure, comprising an elastomer, a flexible conductor and a conductive circuit board from top to bottom, wherein the conductive circuit board is respectively provided with a circuit anode and a circuit cathode, the flexible conductor comprises a flexible body and a conductive layer on the flexible body; when pressing the elastomer, the circuit is switched on if the conductive layer on the flexible conductor is in contact with the circuit anode and the circuit cathode on the conductive circuit board; when loosening the elastomer, the circuit is switched off if the conductive layer on the flexible conductor is separated from the circuit anode and the circuit cathode on the conductive circuit board, wherein the conductive circuit board comprises an upper layer, a circuit layer and a lower layer from top to bottom; the circuit anode and the circuit cathode are arranged on the circuit layer, the upper layer is provided with a first central hole used for providing a contact place for the conductive layer and the circuit anode and the circuit cathode, an upper surface of the circuit layer on two sides of the first central hole is a circuit face, a first air hole is arranged the circuit layer under the first central hole, a first ventilation path is arranged between the circuit layer and the lower layer, and the air in the first central hole is communicated with the outside through the first air hole and the first ventilation path, and wherein one side of the first central hole is defined entirely by the conductive layer.

2. The keyboard structure according to claim 1, wherein the conductive circuit board comprises an upper layer, a circuit protection layer and a circuit layer from top to bottom; the circuit anode and the circuit cathode are arranged on the circuit layer, and the upper layer and the circuit protection layer are commonly provided with a second central hole used for providing a contact place for the conductive layer and the circuit anode and the circuit cathode, the upper surface of the circuit layer at two sides of the second central hole is a circuit face, meanwhile, a second ventilation path is arranged between the upper layer and the circuit protection layer, and air in the second central hole is connected with the outside through the second ventilation path.

3. The keyboard structure according to claim 1, wherein the flexible body is made of flexible rubber or flexible plastics.

4. The keyboard structure according to claim 1, wherein the conductive layer is a printed conductive material or a conductive film.

5. The keyboard structure according to claim 1, wherein the elastomer, the flexible conductor and the conductive circuit board are hermetically connected with each other.

6. The keyboard structure according to claim 1, wherein the upper layer, the circuit layer and the lower layer on the conductive circuit board are hermetically connected with each other.

7. The keyboard structure according to claim 1, wherein the conductive circuit board comprises an upper layer, a circuit protection layer and a circuit layer from top to bottom; the circuit anode and the circuit cathode are arranged on the circuit layer, and the upper layer and the circuit protection layer are commonly provided with a second central hole used for providing a contact place for the conductive layer and the circuit anode and the circuit cathode, the upper surface of the circuit layer at two sides of the second central hole is a circuit face, and wherein the upper layer, the circuit protection layer and the circuit layer on the conductive circuit board are hermetically connected with each other.

8. The keyboard structure according to claim 5, wherein the hermetic connection is fitting by waterproof glue.

9. A keyboard structure, comprising an elastomer, a flexible conductor and a conductive circuit board from top to bottom, wherein the conductive circuit board is respectively provided with a circuit anode and a circuit cathode, the flexible conductor comprises a flexible body and a conductive layer on the flexible body; when pressing the elastomer, the circuit is switched on if the conductive layer on the flexible conductor is in contact with the circuit anode and the circuit cathode on the conductive circuit board; when loosening the elastomer, the circuit is switched off if the conductive layer on the flexible conductor is separated from the circuit anode and the circuit cathode on the conductive circuit board, and wherein the conductive circuit board comprises an upper layer, a circuit layer and a lower layer from top to bottom; the circuit anode and the circuit cathode are arranged on the circuit layer, the upper layer is provided with a first central hole used for providing a contact place for the conductive layer and the circuit anode and the circuit cathode, an upper surface of the circuit layer on two sides of the first central hole is a circuit face, a first air hole is arranged through the circuit layer under the first central hole, a first ventilation path is arranged between a lower surface of the circuit layer and an upper surface of the lower layer, and the air in the first central hole is communicated with the outside through the first air hole and the first ventilation path, wherein one side of the first central hole is defined entirely by the conductive layer.

10. The keyboard structure according to claim 9, wherein the flexible body is made of flexible rubber or flexible plastics.

11. The keyboard structure according to claim 9, wherein the conductive layer is a printed conductive material or a conductive film.

12. The keyboard structure according to claim 9, wherein the elastomer, the flexible conductor and the conductive circuit board are hermetically connected with each other.

13. The keyboard structure according to claim 9, wherein the upper layer, the circuit layer and the lower layer on the conductive circuit board are hermetically connected with each other.

14. A keyboard structure, comprising an elastomer, a flexible conductor and a conductive circuit board from top to bottom, wherein the conductive circuit board is respectively provided with a circuit anode and a circuit cathode, the flexible conductor comprises a flexible body and a conductive layer on the flexible body; when pressing the elastomer, the circuit is switched on if the conductive layer on the flexible conductor is in contact with the circuit anode and the circuit cathode on the conductive circuit board; when loosening the elastomer, the circuit is switched off if the conductive layer on the flexible conductor is separated from the circuit anode and the circuit cathode on the conductive circuit board wherein the conductive circuit board comprises an upper layer, a circuit protection layer and a circuit layer from top to bottom; the circuit anode and the circuit cathode are arranged on the circuit layer, and the upper layer and the circuit protection layer are commonly provided with a second central hole used for providing a contact place for the conductive layer and the circuit anode and the circuit cathode, an upper surface of the circuit layer at two sides of the second central hole is a circuit face, meanwhile, a second ventilation path is arranged between a lower surface of the upper layer and an upper surface of the circuit protection layer, and air in the second central hole is connected with the outside through the second ventilation path, wherein one side of the second central hole is defined entirely by the conductive layer.

15. The keyboard structure according to claim 14, wherein the flexible body is made of flexible rubber or flexible plastics.

16. The keyboard structure according to claim 14, wherein the conductive layer is a printed conductive material or a conductive film.

17. The keyboard structure according to claim 14, wherein the elastomer, the flexible conductor and the conductive circuit board are hermetically connected with each other.

18. The keyboard structure according to claim 14, wherein the upper layer, the circuit layer and the lower layer on the conductive circuit board are hermetically connected with each other.

* * * * *